US007628673B2

(12) United States Patent
Bedford et al.

(10) Patent No.: US 7,628,673 B2
(45) Date of Patent: Dec. 8, 2009

(54) PLAY SET WITH TOY VEHICLE-RELATED ASSEMBLY

(75) Inventors: Jonathan Bedford, Hawthorne, CA (US); Eric So, Tsing Yi (HK)

(73) Assignee: Mattel, Inc., El Segundo, CA (US)

( * ) Notice: Subject to any disclaimer, the term of this patent is extended or adjusted under 35 U.S.C. 154(b) by 362 days.

(21) Appl. No.: 11/333,987

(22) Filed: Jan. 17, 2006

(65) Prior Publication Data

US 2006/0286896 A1 Dec. 21, 2006

Related U.S. Application Data

(60) Provisional application No. 60/691,465, filed on Jun. 16, 2005.

(51) Int. Cl.
*A63H 18/00* (2006.01)

(52) U.S. Cl. ..... 446/444

(58) Field of Classification Search ..... 446/444–447, 446/429, 430, 71–73, 75, 77, 78; 238/10 R, 238/10 A See application file for complete search history.

(56) References Cited

U.S. PATENT DOCUMENTS

| | | | | |
|---|---|---|---|---|
| 1,506,771 A | | 9/1924 | O'Leary | |
| 2,239,395 A | | 4/1941 | Mallory | |
| 2,392,722 A | | 1/1946 | Burlin | |
| 3,126,670 A | | 3/1964 | Smith | |
| 3,299,565 A | | 1/1967 | Yarashes | |
| 3,308,575 A | | 3/1967 | Lemelson | |
| 3,377,958 A | * | 4/1968 | Bax et al. | 463/63 |
| 3,451,161 A | | 6/1969 | Lemelson | |
| 3,480,210 A | * | 11/1969 | Perrinjaquet | 238/10 R |
| 3,494,070 A | | 2/1970 | Lemelson | |
| 3,518,789 A | | 7/1970 | Domashovetz | |
| 3,531,119 A | | 9/1970 | Bonanno | |
| 3,546,809 A | * | 12/1970 | Nielsen | 446/441 |

(Continued)

FOREIGN PATENT DOCUMENTS

CA 2396567 7/2001

(Continued)

OTHER PUBLICATIONS

Canadian Office Action mailed Dec. 7, 2007 for Canadian application No. 2,525,039.

(Continued)

*Primary Examiner*—Gene Kim
*Assistant Examiner*—Alyssa M Hylinski
(74) *Attorney, Agent, or Firm*—Kolisch Hartwell, P.C.

(57) ABSTRACT

A toy vehicle play set may include a toy vehicle and a track assembly including a track along which the vehicle may travel. In some examples the vehicle may include a drive mechanism that is adjustable for changing the speed of the vehicle, and a play set may include a speed changer for selectively changing the vehicle speed. In some examples, the track assembly may include a selectively actuated trapdoor in the track. In some examples, the play set may include a vehicle trap assembly having a cover defining a chamber for receiving, for example, a vehicle passing through the trapdoor opening. In some examples, the vehicle trap may include an assembly, such as the vehicle trap that falls apart when contacted by a vehicle traveling along the track.

10 Claims, 13 Drawing Sheets

U.S. PATENT DOCUMENTS

| | | | | | |
|---|---|---|---|---|---|
| 3,633,308 | A | | 1/1972 | Yang | |
| 3,656,586 | A | | 4/1972 | Robson | |
| 3,665,636 | A | | 5/1972 | Benson et al. | |
| 3,690,393 | A | | 9/1972 | Guy | |
| 3,693,291 | A | * | 9/1972 | Aoki | 446/441 |
| 3,707,805 | A | | 1/1973 | Buck | |
| 3,751,847 | A | * | 8/1973 | Neuhierl | 446/429 |
| 3,789,543 | A | * | 2/1974 | Kirby | 446/429 |
| 3,797,164 | A | | 3/1974 | Glass | |
| 3,953,938 | A | | 5/1976 | Kilgore | |
| 4,045,908 | A | | 9/1977 | Ensmann | |
| 4,068,392 | A | | 1/1978 | Montgomery | |
| 4,068,402 | A | | 1/1978 | Tanaka | |
| 4,087,935 | A | | 5/1978 | Edmisson et al. | |
| 4,091,995 | A | | 5/1978 | Barlow et al. | |
| 4,106,695 | A | | 8/1978 | Carella et al. | |
| 4,116,084 | A | * | 9/1978 | Masuda | 74/342 |
| 4,185,409 | A | | 1/1980 | Cheng | |
| 4,188,748 | A | * | 2/1980 | Rich et al. | 446/430 |
| 4,221,076 | A | | 9/1980 | Ozawa | |
| 4,241,534 | A | | 12/1980 | Larsson et al. | |
| 4,254,576 | A | | 3/1981 | Matsumoto et al. | |
| 4,266,769 | A | * | 5/1981 | Saitoh | 463/62 |
| 4,312,151 | A | | 1/1982 | Orenstein | |
| 4,333,261 | A | | 6/1982 | Jones et al. | |
| 4,373,289 | A | * | 2/1983 | Douglas et al. | 446/487 |
| 4,386,777 | A | | 6/1983 | Prehodka | |
| 4,459,438 | A | | 7/1984 | Kaiser | |
| 4,468,031 | A | | 8/1984 | Barlow et al. | |
| 4,519,789 | A | | 5/1985 | Halford | |
| 4,536,168 | A | | 8/1985 | Stephens | |
| 4,536,169 | A | | 8/1985 | Fekete et al. | |
| 4,540,380 | A | * | 9/1985 | Kennedy et al. | 446/463 |
| 4,661,080 | A | | 4/1987 | Goldstein et al. | |
| 4,697,812 | A | | 10/1987 | Rudell et al. | |
| 4,940,444 | A | | 7/1990 | Russell | |
| 4,979,926 | A | | 12/1990 | Bisceglia | |
| 4,990,117 | A | | 2/1991 | Yonezawa | |
| 5,038,685 | A | | 8/1991 | Yoneda | |
| 5,052,972 | A | * | 10/1991 | Suimon et al. | 446/429 |
| 5,080,627 | A | | 1/1992 | Oriya et al. | |
| 5,165,347 | A | | 11/1992 | Wagner | |
| 5,342,048 | A | | 8/1994 | Jones et al. | |
| 5,452,893 | A | | 9/1995 | Faulk et al. | |
| 5,601,490 | A | | 2/1997 | Nakagawa et al. | |
| 5,678,489 | A | | 10/1997 | Wang | |
| 5,683,298 | A | * | 11/1997 | Jackson | 463/58 |
| 5,865,661 | A | | 2/1999 | Cyrus et al. | |
| 5,890,945 | A | | 4/1999 | Asami et al. | |
| 5,931,714 | A | | 8/1999 | Johnson | |
| 5,974,977 | A | | 11/1999 | Johnson et al. | |
| 6,093,079 | A | | 7/2000 | House | |
| 6,173,654 | B1 | | 1/2001 | Ngai | |
| 6,193,581 | B1 | | 2/2001 | Wiggs et al. | |
| 6,343,972 | B1 | * | 2/2002 | Ogawa et al. | 446/444 |
| 6,422,151 | B2 | | 7/2002 | Maleika | |
| 6,478,654 | B1 | | 11/2002 | Rehkemper et al. | |
| 6,482,070 | B2 | | 11/2002 | Hogan | |
| 6,508,179 | B2 | * | 1/2003 | Annis et al. | 104/60 |
| 6,565,410 | B1 | * | 5/2003 | Allen | 446/454 |
| 6,602,107 | B1 | | 8/2003 | Hogan | |
| 6,676,480 | B2 | | 1/2004 | Sheltman | |
| 6,764,376 | B2 | | 7/2004 | Agostini | |
| 6,805,609 | B1 | | 10/2004 | Paukert | |
| 7,517,272 | B2 | | 4/2009 | Bedford et al. | |
| 2003/0224697 | A1 | | 12/2003 | Sheltman et al. | |
| 2005/0176338 | A1 | * | 8/2005 | Delaney | 446/92 |
| 2006/0141902 | A1 | * | 6/2006 | Sinisi | 446/445 |

FOREIGN PATENT DOCUMENTS

| | | | | |
|---|---|---|---|---|
| DE | 3240712 | | | 5/1984 |
| DE | 3409975 | | | 9/1985 |
| DE | 3500533 | | | 7/1986 |
| DE | 3625667 | | | 1/1987 |
| DE | 3628961 | | | 11/1987 |
| DE | 3703045 | A1 | * | 8/1988 |
| DE | 3941093 | | | 6/1991 |
| EP | 0091971 | | | 10/1983 |
| EP | 0105058 | | | 4/1984 |
| EP | 0200837 | | | 11/1986 |
| EP | 0280496 | | | 8/1988 |
| EP | 1120144 | | | 8/2001 |
| GB | 0477953 | | | 1/1938 |
| GB | 1380660 | | | 1/1975 |
| GB | 2099712 | A | * | 12/1982 |
| GB | 2123704 | | | 2/1984 |
| GB | 2180768 | | | 4/1987 |
| GB | 2230467 | | | 10/1990 |
| JP | 6081504 | A | | 3/1994 |
| WO | 0123058 | | | 4/2001 |
| WO | 2004016333 | | | 2/2004 |

OTHER PUBLICATIONS

Rev-Ups Skyway Stunt Set, 12 sheets total, comprising: (A) Fall 2004 Mattel Toy Sell Sheets, cover page and p. 39 showing Rev-Ups Skyway Stunt Set (2 sheets); (B) Photographs showing product packaging (2 sheets); and photographs showing the product (8 sheets). The Rev-Ups Skyway Stunt Set was publicly disclosed in the Toy Sell Sheets in the fall of 2004.

Moon Adventure toy play set, sold by Guangdong Auldey Toy Industry Ltd of Guangdong, China, package shows a 2004 copyright notice, 6 sheets total, comprising: (A) photographs of the package for the toy playset (2 sheets) and (B) photographs of the toy playset (4 sheets).

U.S. Patent and Trademark Office, Office action for U.S. Appl. No. 11/333,988, mailing date Jul. 1, 2008, 30 pages. The '998 application has the same inventors as the present '897 application. The '988 OA includes a full copy and English abstract of JP6081504A cited above and separately disclosed.

U.S. Patent and Trademark Office, Office action for U.S. Appl. No. 11/334,180, mailing date Apr. 9, 2008, 12 pages. The '180 application has the same inventors as the present '987 application.

Canadian Intellectual Property Office, Office Action for Canadian patent application No. 2,525,022 (which has the same inventors as U.S. Appl. No. 11/333,987), dated Nov. 27, 2008, three pages total. Applications concurrently disclose CA 2,396,567 (national phase of WO 2001/51155) cited in this Office action.

Division of Patents of the Mexican Institute of Industrial Property, Office Action for Mexican patent application No. PA/a/2005/011764 (has the same inventors as U.S. Appl. No. 11/333,987), dated Aug. 26, 2008, seven pages total. The disclosure includes the Spanish-language Office action plus a partial English-language translation prepared by our Mexican agent.

Canadian Intellectual Property Office, Office Action for Canadian patent application No. 2,525,039 (which has the same inventors as the '987 application) dated Dec. 7, 2007, 3 pages.

Canadian Intellectual Property Office, Office Action for Canadian patent application No. 2,525,024 (which has the same inventors as the '987 application) dated Nov. 26, 2008, 2 pages.

U.S. Patent and Trademark Office, Office Action for U.S. Appl. No. 11/333,988, mailing date Dec. 19, 2008, 12 pages. The '988 application has the same inventors as the present '987 application.

U.S. Patent and Trademark Office, Issue Notification for U.S. Appl. No. 11/334,180 mailing date Mar. 25, 2009, 1 page. The '180 application has the same inventors as the present '987 application.

U.S. Patent and Trademark Office, Notice of Allowance for U.S. Appl. No. 11/333,988, mailing date Mar. 30, 2009, 10 pages. The '988 application has the same inventors as the present '987 application.

Division of Patents of the Mexican Institute of Industrial Property, Office Action for Mexican patent application No. PA/a/2005/011690 (which corresponds to U.S. Appl. No. 11/334,180 having the same inventors as the present '987 application), dated Apr. 15, 2009, 7 pages total. The disclosure includes the Spanish-language Office action plus a partial English-language translation prepared by our Mexican Agent.

Division of Patents of the Mexican Institute of Industrial Property, Office Action for Mexican patent application No. PA/a/2005/011765 (having the same inventors as the present '987 application), dated Apr. 23, 2009, 5 pages total. The disclosure includes the Spanish-language Office Action plus a partial English-language translation prepared by our Mexican agent.

Division of Patents of the Mexican Institute of Industrial Property, Office Action for Mexican patent application No. PA/a/2005/011765 (having the same inventors as the present '987 application), dated May 22, 2009, 5 pages total. The disclosure includes the Spanish-language Office Action plus a partial English-language translation prepared by our Mexican agent.

* cited by examiner

PLAY SET WITH TOY VEHICLE-RELATED ASSEMBLY

RELATED APPLICATION

This application claims the benefit of U.S. Provisional Application No. 60/691,465 filed on Jun. 16, 2005, Mexican Application No. 2005/011765, filed Nov. 1, 2005 of the same title, and Canadian Application No. 2,525,024, filed Nov. 1, 2005 of the same title, which are incorporated herein by reference for all purposes.

BACKGROUND OF THE DISCLOSURE

Play sets including toy vehicle tracks and accompanying toy vehicles are a source of entertainment for children. Toy vehicle tracks having different features may increase the enjoyment of children using the tracks. Examples of toy vehicle tracks can be found in U.S. Pat. Nos. 2,239,395, 3,126,670, 3,299,565, 3,665,636, 3,690,393, 3,797,164, 4,068,402, 4,087,935, 4,091,995, 4,106,695, 4,185,409, 4,221,076, 4,254,576, 4,459,438, 4,468,031, 4,519,789, 4,536,168, 4,661,080, 4,697,812, 4,979,926, 5,052,972, 5,452,893, 5,601,490, 5,678,489, 5,865,661, 5,890,945, 5,931,714, 6,093,079, 6,193,581, 6,478,654, 6,508,179, 6,676,480, RE32,106 and U.S. Application Publication No. 2003/0224697. Different types of toy vehicles suitable for use on toy vehicle tracks can be found in U.S. Pat. Nos. 4,087,935, 4,241,534, 4,333,261, 4,536,169, 4,940,444, 6,422,151, and 6,764,376. All of the aforementioned references are incorporated herein by reference for all purposes.

SUMMARY OF THE DISCLOSURE

A toy vehicle play set may include a toy vehicle and a track assembly including a track along which the vehicle may travel. In some examples an assembly may be operable for changing the operation of a toy vehicle. For example, the vehicle may include a drive mechanism that is adjustable for changing the speed of the vehicle, and a speed changer may be used for selectively changing the speed of the vehicle as the vehicle travels along a track. In some examples, an assembly may alter the travel of a vehicle, such as a trapdoor in the track and a release mechanism adapted to be actuated selectively to open the trapdoor. In some examples the track may have a junction providing at least first and second alternate path portions, and a switching mechanism configured to direct the vehicle along one or the other of the path portions depending on the vehicle operation, such as the speed of the vehicle.

In some examples, the play set may further include an action device adapted to produce selectively a given action and an actuator disposed for actuation by a vehicle traveling along a path for causing the action device to produce the given action. In some examples, a play set may include a vehicle trap assembly having a cover defining a chamber, the cover being movable between open and closed positions and disposed to receive a vehicle traveling along a travel path. In some examples the action device is an assembly that disassembles upon actuation of a trigger by a vehicle. In some examples, an assembly may provide a combination of actions that function depending on the travel path of a vehicle.

DETAILED DESCRIPTION OF AN EXEMPLARY PLAY SET

A toy vehicle play set may include a track adapted for use with a toy vehicle. Such a play set may include a track assembly having a track with a first vehicle-support surface defining a travel path, and one or more vehicle-related assemblies disposed along the path. When a plurality of such vehicle-related assemblies are provided, the vehicle-related assemblies may be independent of each other, or one or more of them may relate in some way. Many variations of such play sets may be envisioned. For example, for the purpose of increasing the level of enjoyment a person may derive from playing with a plat set, a plurality of related vehicle-related assemblies may be provided.

Figure 1:
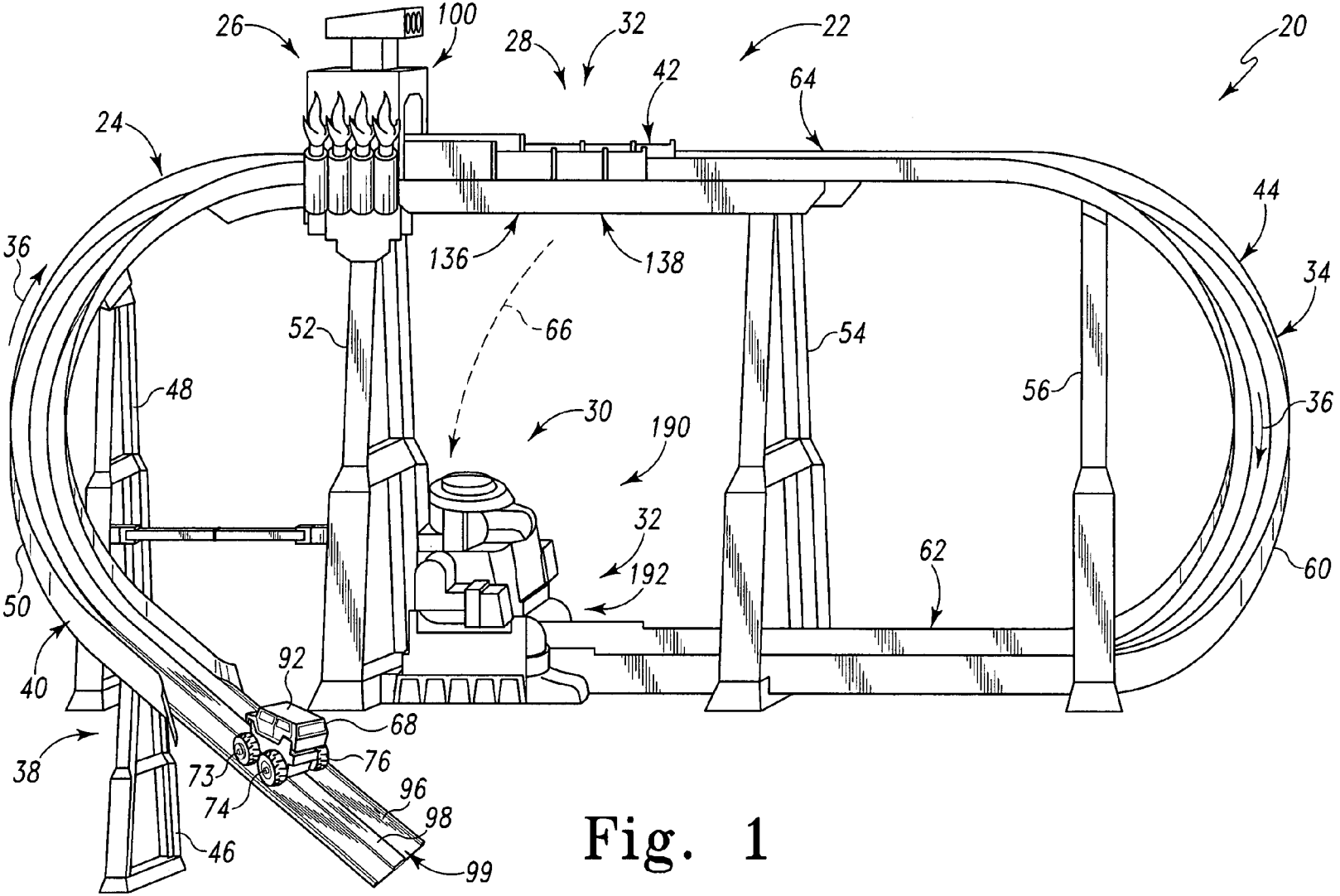
FIG. 1 is a perspective view of a play set including a toy vehicle supported on a track assembly.

An example of such a play set 20 having a plurality of vehicle-related assemblies 22 is illustrated in FIG. 1. Such a play set is available from Mattel, Inc. and is sold under the proprietary name "Tomb Trap™." For example, play set 20 may include one or more of such vehicle related assemblies as a track assembly 24, a vehicle-operation changing assembly 26, a vehicle junction assembly 28, a vehicle trap assembly 30, and an action assembly 32. Track assembly may include a track 34, defining a travel path 36, and a track support assembly 38. The vehicle-related assemblies 22 may be configured in a variety of ways. For example, a play set may only include only one or a combination of the assemblies 22 shown, or may include other vehicle-related assemblies 22, not shown.

A track may include one or a plurality of track sections. The track may be formed with plastic, although other suitable materials, such as metal, may also be used. Furthermore, sections of the track may be molded, although they may also be formed in various other ways as well, such as by cutting or pressing. The track may be comprised of multiple sections that may need to be assembled by the user before using the track. The track may be assembled by various connectors, including any sort of snap fit structure, registration pins, retaining clips, flanges, or any other integral or non-integral structure capable of attaching two or more sections of the track together.

In the example shown, track 34 may include a first track section 40, a second, intermediate track section 42, and a third, final track section 44. A support assembly, such as support assembly 38 may provide support for one or more vehicle-related assemblies. For example, supports 46 and 48 my provide support of track section 40 at different levels, such that track section 40 extends from a play surface, not shown, up a rising incline or ramp 50. Vehicle-operation changing assembly 26 is shown supported on a support 52 positioned at the top of ramp 50. Accordingly, track section 40 and vehicle-operation changing assembly 26 are supported above the play surface.

Intermediate track section 42 may extend from operation-changing assembly 26, and may be associated with a vehicle junction assembly 28. The end of track section 42 is further supported by a support 54. Supports 52 and 54, then, may support at an elevated position, intermediate track section 42, as well as one or more other vehicle-related assemblies 22, such as assemblies 26 and 28. Further supports, such as support 56 may support a portion of track section 44 with a decreasing elevation, forming a declining ramp 60 to a final track portion 62 extending at a selected elevation, such as along the play surface.

Vehicle junction assembly 28 may selectively provide for travel of a vehicle along a first travel path portion 64 extending along track section 44, or along a second travel path portion 66 extending downwardly to trap assembly 30.

As mentioned, a play set may be associated with a toy vehicle. The toy vehicles used on a toy vehicle track may utilize any suitable type of propulsion. For example, toy vehicles may allow the wheels on the toy vehicle to spin freely when pushed. Toy vehicles may also be propelled by an energy source, such as by using one or more batteries or other source of electric power, by using magnetic forces, by using mechanical forces such as provided by a spring, or by using an inertial flywheel motor that gains its rotational energy by spinning the wheels of the toy vehicle. Toy vehicles may maintain contact with a track in various ways. For example, contact between the vehicle and the track may be maintained by gravity, by utilizing the speed of the propelled toy vehicle, by using magnetic forces, and/or by securing the toy vehicle to the track mechanically.

In some examples, the toy vehicle may be unmotorized or may be motorized, and may have a single speed or a plurality of speeds. The vehicle-related assemblies may be configured to function with a toy vehicle having one or more particular characteristics. A toy vehicle may be configured to perform a given operation, with the toy vehicle including an operation-changing mechanism configured to be actuated selectively to change a given operation of the vehicle. For example, a toy vehicle may have a drive mechanism coupled to one or more wheels and be configured to drive the vehicle selectively in at least first and second speeds. In such a vehicle, the operation-changing mechanism may be a switch mechanism included in the drive mechanism and having a speed switch element movable for switching the speed of the vehicle.

Figure 2:
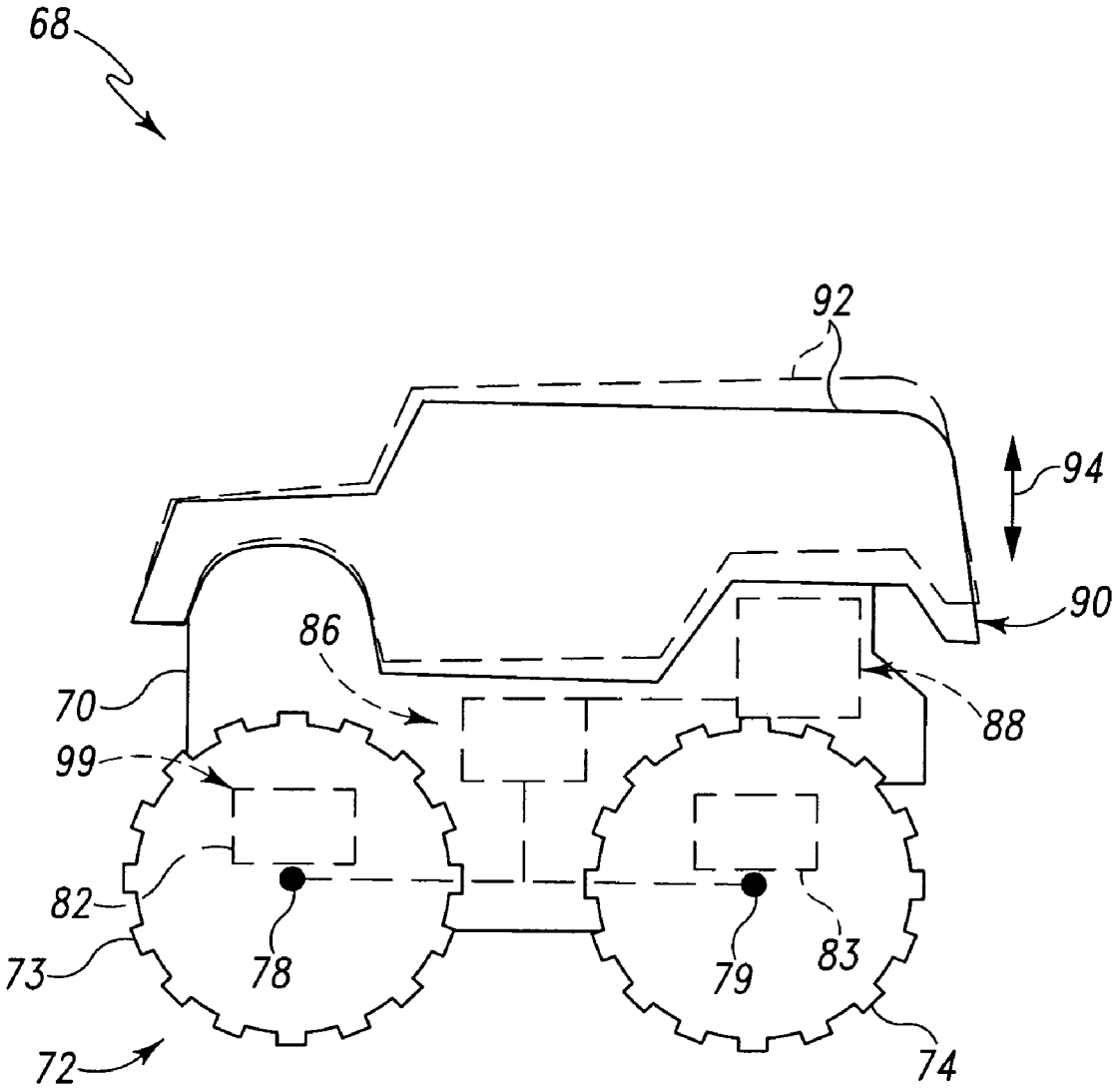
FIG. 2 is a perspective view of a speed changer included in the play set of FIG. 1.

In the example of play set 20, a self-propelled, plural-speed toy vehicle 68 may be provided. FIG. 1 shows a perspective view of the toy vehicle 68 traveling up ramp 50. A side view of vehicle 68 is shown in FIG. 2. Toy vehicle 68 may include a body 70 supported by a plurality of wheels 72, such as wheels 73, 74, 75, 76. As used herein, a wheel is considered the rotating structure on which the vehicle is supported, and includes what may be considered to be the tire, if any, as well as the rim on which a tire may be mounted. Each wheel may rotate about an axis of rotation. In this example, wheels 73 and 75 rotate about a common wheel axis 78. Wheels 74 and 76 may also rotate about a similar common wheel axis 79.

Furthermore, the toy vehicle 68 may include one or more magnets in or on the underside of body 70. The illustrated toy vehicle has two permanent magnets 82, 83. The magnet or magnets may each or in combination be any source of a magnetic field. Thus, other forms of magnets may also be used, such as electromagnets. The magnets may be in any suitable position on the toy vehicle. In this example, magnet 82 may be aligned between wheels 73 and 75, while magnet 83 may be aligned between wheels 74 and 76. The magnets 82, 83 may be positioned on the vehicle so that when the vehicle is on a track, the magnets are elevated a sufficient distance above the track to avoid making direct contact with the track. As will be described, the vehicle magnets may be positioned sufficiently low to provide a strong magnetic force of attraction with a movable or stationary track element having a magnetic or ferromagnetic material.

As indicated generally in FIG. 2, toy vehicle 68 may also include an appropriate drive mechanism 86 to facilitate imparting rotational power to one or more of the toy vehicle wheels to drive the vehicle along the track in a way described below. Toy vehicle drive mechanisms are well known. The toy vehicle 68 may be an inertial-motor-powered toy vehicle, such as a toy vehicle sold by Mattel, Inc. under the trademark "Rev Ups.™" Other toy vehicles with or without drive systems may also be used, such as ones with drive systems that are wind-up, battery powered, electric powered or powered by any other drive mechanism.

Drive mechanism 86 may include a switch mechanism 88 configured to change the speed of the toy vehicle. In one example, the drive mechanism provides a plurality of different speeds for the vehicle, such as a slow speed and a fast speed. Switch mechanism 88 may include a switch element 90 that is configured to be actuated to change the vehicle from one speed to another speed. In the example illustrated in FIG. 2, a top section 92 of the vehicle may provide for changing the vehicle speed. The top section 92 may be hingedly connected to the front of the vehicle body and biased into an upward position. The speed is then switched by moving the rear end of the top section downwardly. Movement of the rear of the top section 92 is illustrated by arrow 94. An exemplary vehicle as has been described is commercially available from Mattel, Inc., as has been mentioned.

Referring again to track assembly 24, track 34 may generally include a generally flat vehicle-support surface 96 with a center portion 97 having a ferromagnetic metal strip 98 extending along the length of the track. This strip 98 may be continuous or discontinuous, and may be enclosed within a channel extending through the track 34, or it may be exposed. A complementary magnetic attraction between strip 98 and vehicle magnets 82, 83 contribute to maintaining the vehicle on the track during travel. Optionally, strip 98 may be formed of magnetic material having a polarity opposite to that of the vehicle magnets, or the vehicle magnets may be replaced with ferromagnetic material. Accordingly, the magnets and the ferromagnetic strip may be referred to generally as magnetic attraction elements 99.

Figure 3:
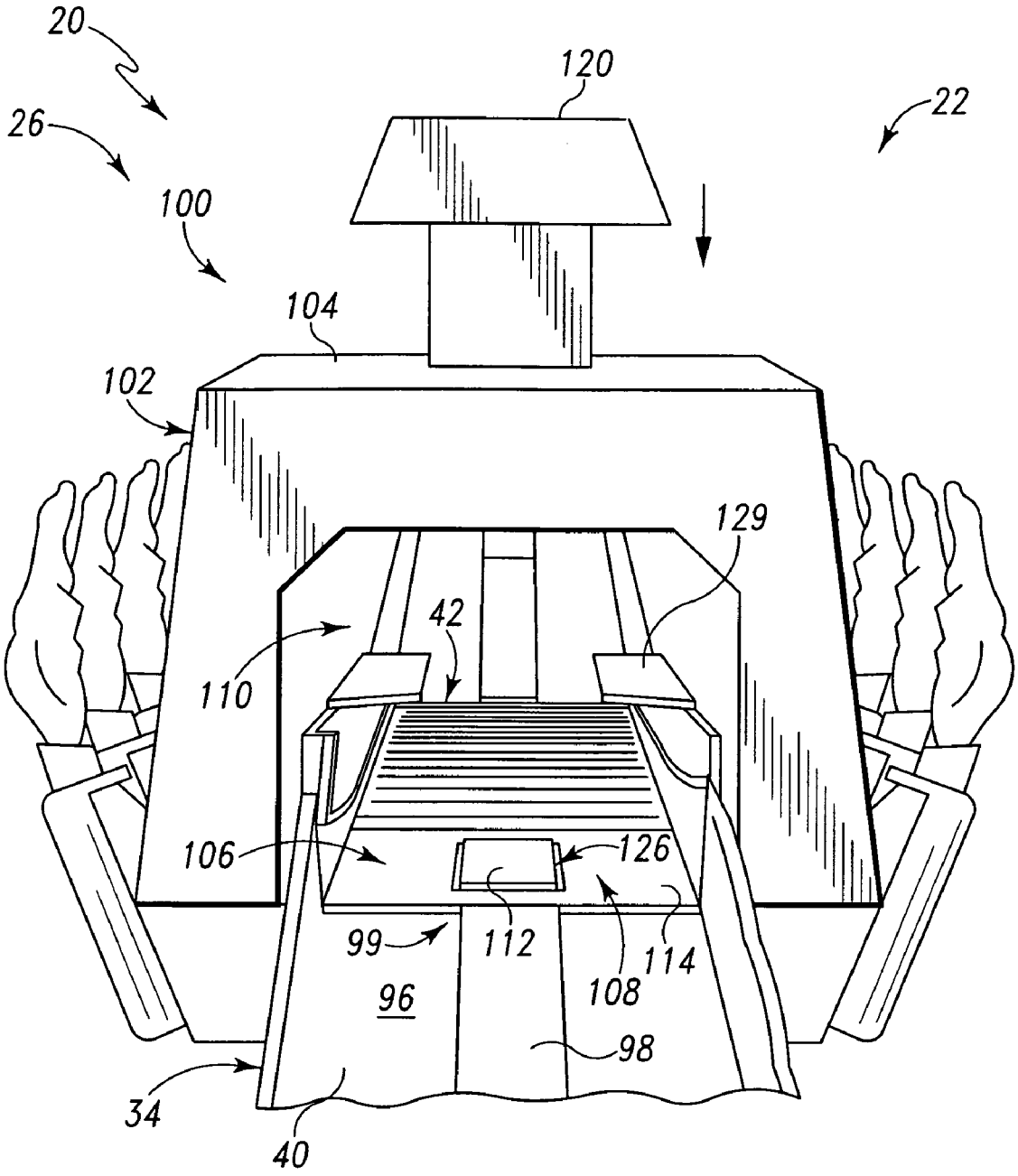
FIG. 3 is a cross section of the speed changer of FIG. 2.
Figure 4:
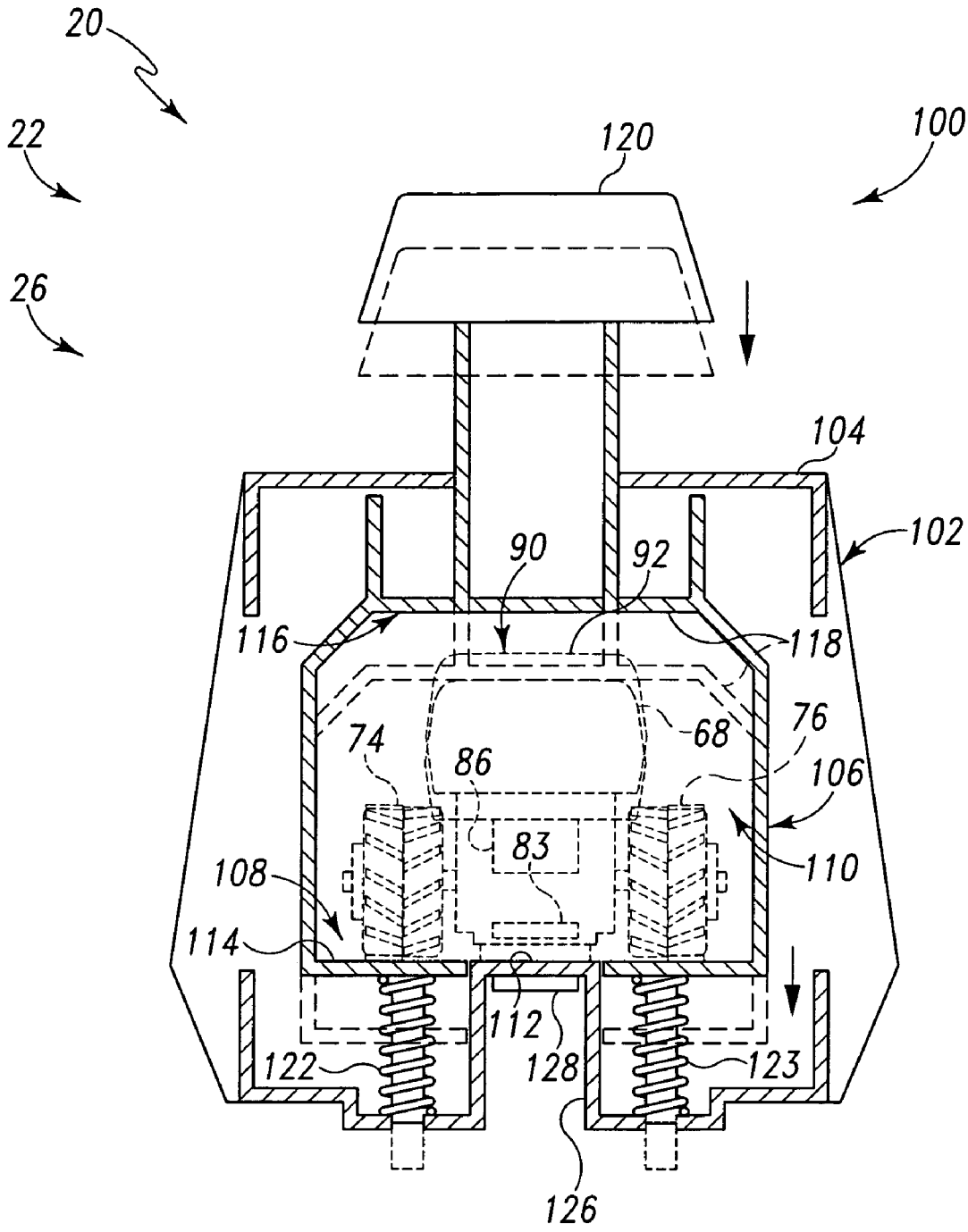
FIG. 4 is a side view of a toy vehicle adapted to be used with the speed changer of FIG. 2.

A vehicle-operation changing assembly may be mounted adjacent to the track and manually operable for selectively changing the given operation of the vehicle while the vehicle is supported on the track in an operation-changing position. FIGS. 3 and 4 depict the vehicle operation changing assembly 26. Assembly 26 may be used for changing the operation of a toy vehicle. In this example, assembly 28 is a speed changer 100 coupled to the end of track section 40 and forming the beginning of track section 42. The speed changer 100 may include a speed shifter housing 102 forming a fixed frame 104. A moveable frame 106 may be mounted for movement relative to frame 104. The speed shifter housing 102 may enclose a section of the track 34 contained on a platform 108, defining a passageway 110 through which a vehicle traveling along travel path 36 may pass. Passageway 110 may serve as a speed-changing position for a vehicle 68. The speed changer platform may be formed by a first, fixed floor surface 112 and a second movable floor surface 114. Movable floor surface 114 may extend along the sides of the fixed floor surface, and may surround the fixed floor surface, as shown.

Movable frame 106 may function as a speed changer actuator 116 that includes a speed-changer member 118 drivingly connected to a handle 120. Frames 104 and 106 further extend downwardly around passageway 110 to form platform 108. Frame 106 is biased upwardly into a raised, ready position, as shown by the solid lines, by compression springs 122 and 123. Other suitable devices for biasing the movable frame toward the raised position may also be used, such as tension springs, leaf springs, and resilient material, such as rubber. Frame is movable downwardly against the bias of the springs toward a lowered or switching position, as shown by the dashed lines. When the movable frame is moved toward the lowered position, speed changer member 116 moves downwardly toward fixed floor surface 112 and movable floor surface 114 drops below the fixed floor surface. The fixed floor surface forms, then, the top of a pedestal 126 that is sized to fit between the wheels 72 of the toy vehicle. Mounted in the top of pedestal 126 is a magnetic attraction element 99 in the form of a ferromagnetic strip 128.

When a toy vehicle 68 travels into passageway 110 of the speed changer 100, handle 120 may be manually depressed when the vehicle is positioned on platform 108 with the vehicle pedestal 126 with the body positioned over fixed floor surface 112 and the wheels supported on movable floor surface 114. Moving the handle downwardly moves the movable frame from the raised position toward the lowered position. As has been discussed, the toy vehicle 68 may be configured to change speeds by pressing down and releasing the top section 92 of the toy vehicle. As movable frame 106 lowers, the speed changer member 118 contacts the top of the vehicle and floor surface 114 lowers, lowering the vehicle.

The vehicle lowers until vehicle body 70 rests on floor surface 112 of pedestal 126. With further movement downwardly of the handle 120, the vehicle wheels 72 separate from floor surface 114, and hang free of contact with any support surface, thereby retaining the vehicle in a parked position on the pedestal. The wheels are allowed to rotate freely while the vehicle is held in position on the pedestal. Further downward travel of the handle results in depression of vehicle top section 92, causing the toy vehicle to change speeds. If, for example, toy vehicle 68 was operating at a lower speed when entering the speed changer, then pressing the speed changer member against the top of the vehicle may shift the speed of the toy vehicle to a higher speed. Conversely, if the vehicle had entered at a higher speed, the speed may be changed to a lower speed. Repeated cycling of handle 120 partially upwardly, without supporting the wheels on floor surface 114, may result in changing the vehicle speed a plurality of times.

During speed changing, although the toy vehicle 68 rests on the pedestal 126, an attraction between the toy vehicle and the pedestal may be further provided by way of the ferromagnetic element 128 in the pedestal and the toy vehicle magnets 82, 83. This complete structure may help to temporarily immobilize the toy vehicle underneath the speed changer member 118 during speed changing.

After the speed changer handle has been depressed and the vehicle speed changed, the handle may be released. When the handle is released, the floor surface 114 of platform 108 may raise to its original position, which may be even with the level of the floor surface 112. This in turn returns the toy vehicle wheels in contact with the platform. The toy vehicle may now progress out of passageway 110 and along the track section 42 at the newly selected speed. Barriers, such as barriers 129 extend along the track after the speed changer and prevent the vehicle from bucking or otherwise rising up due to the increase in speed of the vehicle, thereby maintaining the wheels on the track so that the vehicle can stabilize.

Figure 5:
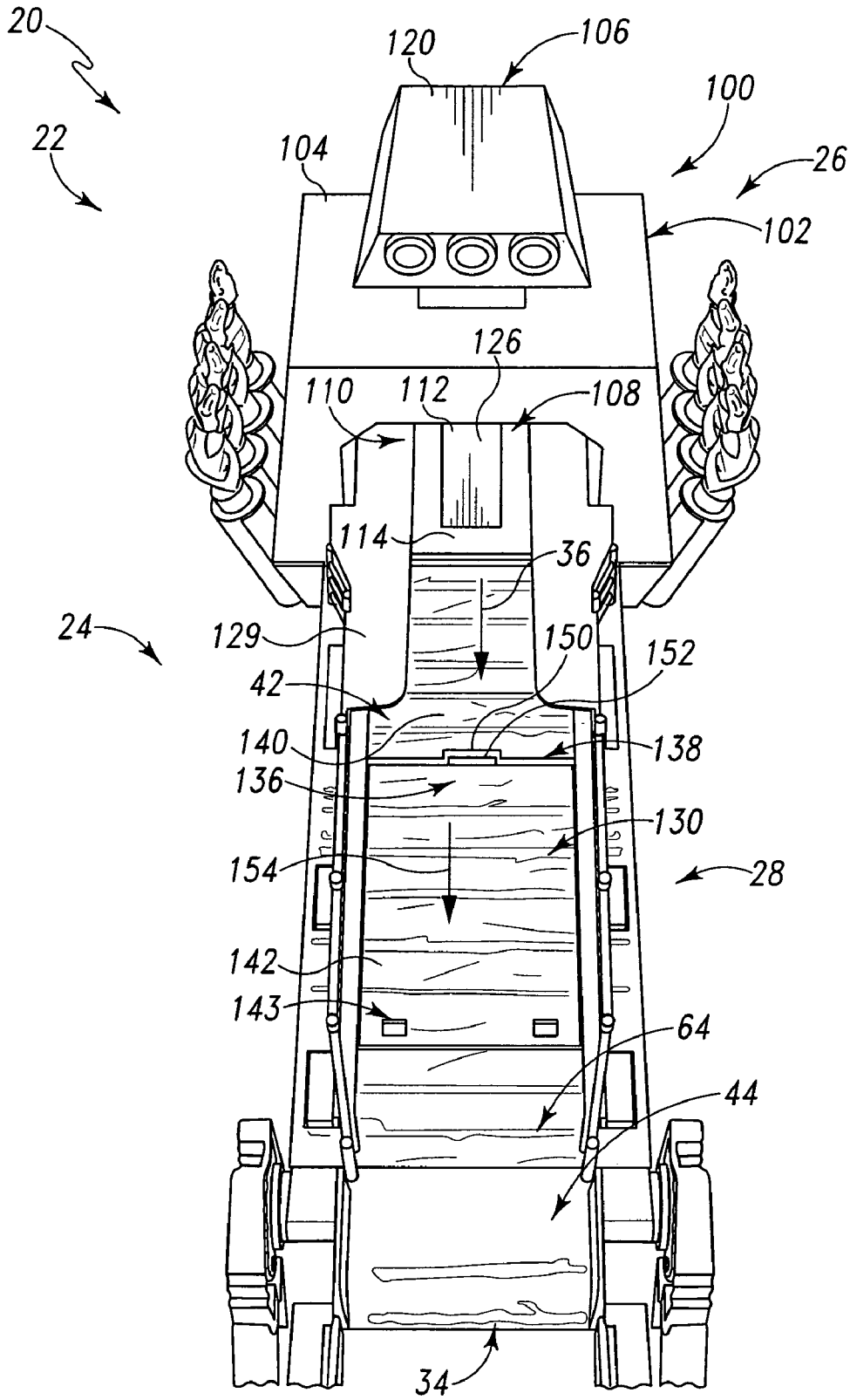
FIG. 5 is a perspective view of the exit side of the speed changer and a trap door assembly included in the play set of FIG. 1.
Figure 6:
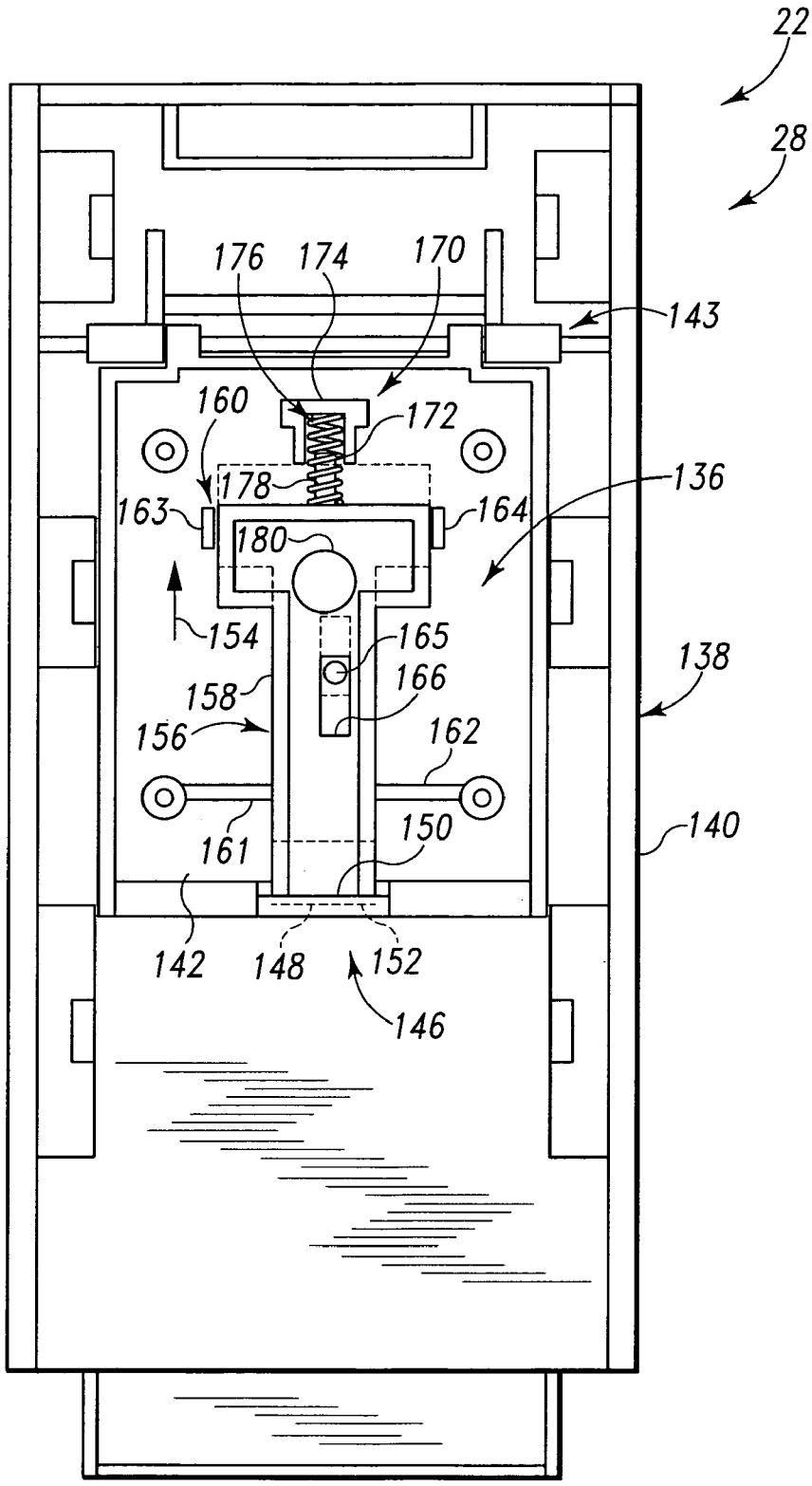
FIG. 6 is a bottom view of the trap door assembly of FIG. 5 with a bottom cover removed.
Figure 7:
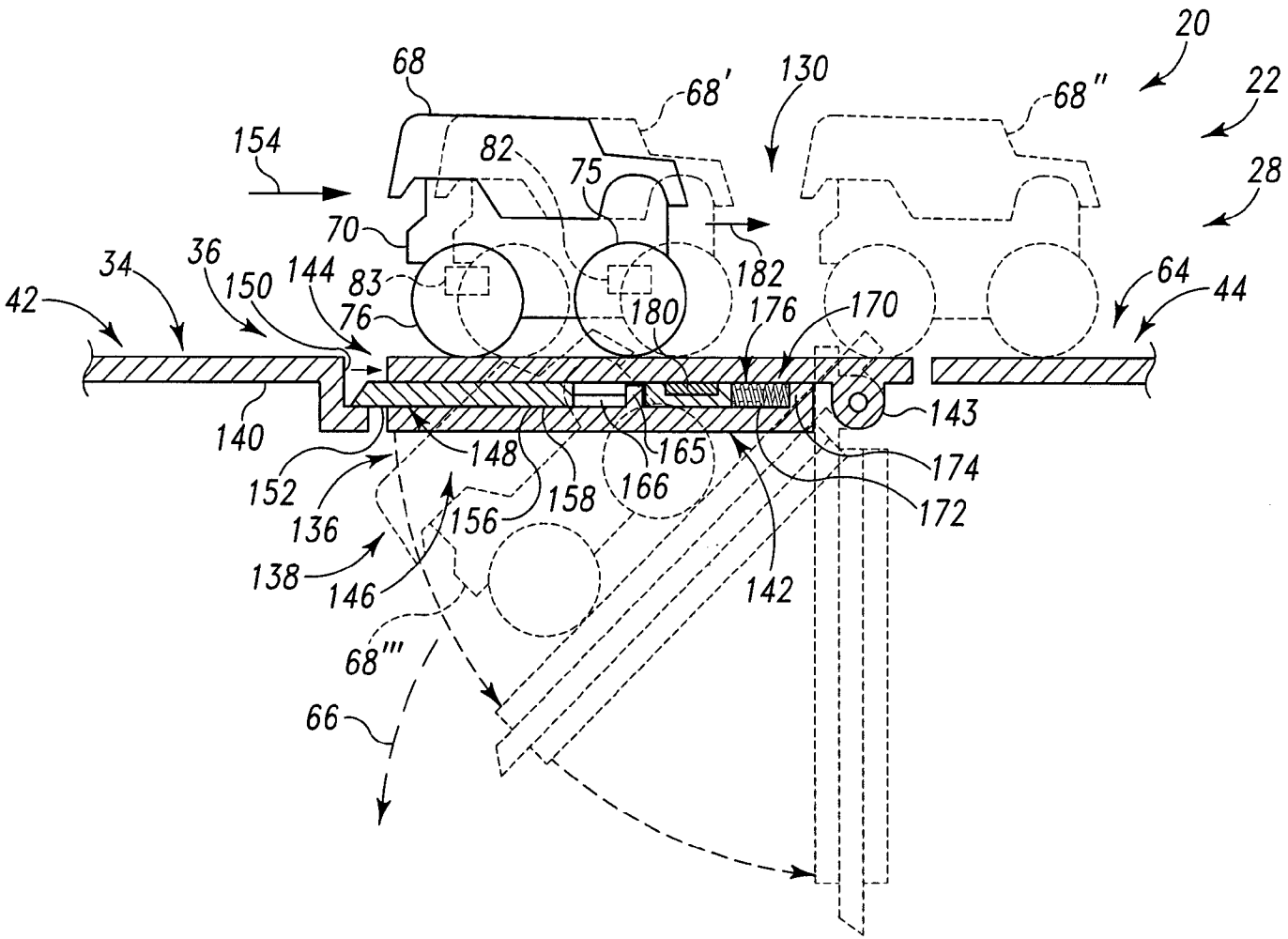
FIG. 7 is a cross section of the trap door assembly of FIG. 5.

FIGS. 5-7 illustrate in further detail vehicle junction assembly 28 and track section 42 of track assembly 24. FIG. 5 shows a top, perspective view; FIG. 6 is a bottom view; and FIG. 7 is a cross section. The junction assembly 28 may connect the speed changer 100 and third track section 44. The junction assembly may include a junction 130 providing at least first and second alternate travel path portions 64 and 66. Path portion 64 extends along track section 44, whereas path portion 66 extends down from junction assembly 28. Junction assembly 28 may further include a switching mechanism 136 configured to direct the vehicle along the first path portion or the second path portion. As will become apparent, switching mechanism 136 may be further configured to direct the vehicle along one of the path portions when the vehicle is going a first vehicle speed, and along the second path portion when the vehicle is going a second vehicle speed that is faster than the first vehicle speed.

In this example, switching mechanism 136 may include a trapdoor assembly 138 having a fixed deck 140 and a trapdoor 142. Trapdoor 142 may be selectively removable from the fixed deck. For example, the trapdoor may be hingedly attached to deck 140 by a hinge 143, allowing pivoting of the trapdoor between a closed position in which the trapdoor is positioned in a corresponding opening 144 in the deck, as shown in FIGS. 5 and 6, and in solid lines in FIG. 7, and an open position in which the trapdoor is spaced from opening 144, as shown by the dashed lines in FIG. 7.

The trapdoor assembly may further include a release mechanism 146 adapted to be actuated selectively to open the trapdoor 142. The release mechanism may be adapted to be actuated by the toy vehicle as the toy vehicle travels along the trapdoor when the trapdoor is in the closed position. Further, the release mechanism 146 may include a lock element 148 that is movable between a lock position in which the trapdoor is secured in the closed position and an unlock position in which the trapdoor is released from the closed position. For example, trapdoor assembly 138 may further include a release mechanism in the form of a latch assembly 148 that selectively secures the trapdoor in the closed position. An exemplary latch assembly is shown particularly in FIGS. 6 and 7. Deck 140 may include a cavity or catch 150 aligned with an edge of trapdoor 142 opposite hinge 143. A latch 152 is configured to be freely received in catch 150 in a lock position. The latch may be moved from the lock position in catch 150 toward an unlock position in which the latch is removed from the catch.

In some examples, the toy vehicle may travel in a given direction along the path, as represented by arrow 154, and the release mechanism may include a drive element 156 operatively coupled to the lock element 148, the drive element being movable along the track at least partially in line with the given direction for moving the lock element 148 (latch 152) from the lock position to the unlock position. Drive element 156 may be any structure or apparatus configured to convey a driving force to lock element 148 (latch 152) sufficient to move the lock element from the lock position toward the unlock position. For example, the drive element may be a lever arm that pivots, a solenoid, a motor or the like. In the example shown in the figures, drive element 156 may include a slide element 158 attached directly to catch 150. Slide element 158 is positioned in a channel 160 formed in the underside of trapdoor 142 by guides 161, 162, 163, 164 and 165 extending from the trapdoor. Guide 165 is in the form of a post extending through an elongate slot 166 in slide element 158. When a bottom cover panel 168 is mounted to the trapdoor, channel 160 limits movement of slide element 158 to movement in line with direction 154.

A bias mechanism 170, such as a spring 172, may bias slide element 158 and catch 150 toward the lock position. One end of spring 172 is mounted to the trapdoor by a seat 174 that extends from the trapdoor, as shown, to form a recess 176 with bottom cover panel 162 that captures the end of the spring. A bar 178 extends from an end of slide element 158 toward recess 176 and into the other end of spring 172. Release mechanism 148 is shown in the lock position in solid lines. The unlock position is shown in dashed lines.

In some examples, the drive element 156 may include a magnetic-attraction element 99 complementary to a magnetic-attraction element 99 in the toy vehicle, whereby the drive-element magnetic-attraction element is magnetically attracted to the toy-vehicle magnetic-attraction element. Specifically, drive element 156 may include a magnet 180 with a pole directed toward the top surface of the trapdoor that is opposite to the downwardly directed pole of magnets 82, 83 of the toy vehicle. The image of vehicle 68 in solid lines in FIG. 7 shows the position of the vehicle with front magnet 82 directly over slider magnet 180. The use of two magnets produces a stronger force of attraction between them than does a single magnet of the same strength and a ferromagnetic material, although that configuration may be suitable in some applications. The movement of the vehicle past magnet 180, as represented by arrow 182 and vehicle 68', to an advanced position, causes the slider magnet to be drawn toward the vehicle magnet. This causes the slide element 158 to move in channel 160 along the trap door in the direction of arrow 154 against the force of spring 166. This in turn causes latch 152 to withdraw from catch 150, and move from the lock position toward the unlock position, allowing the trapdoor to open. The trapdoor may be moved manually from the open position to the closed position, with the latch having a tapered surface that causes the latch to retract to allow it to align with the catch.

Depending on the speed of vehicle 68, the vehicle will travel along travel path portion 64 on deck 140, as is indicated by vehicle 68", or will fall through opening 144, as is indicated by vehicle 68'''. For a vehicle of a particular weight, then, there may be a critical speed above which the vehicle is able to pass over the trapdoor before latch mechanism has time to work or before the trapdoor opens enough to halt the progress of the vehicle.

Below the critical speed, the latch mechanism moves along with the vehicle, and the trapdoor drops open, swinging about hinge 143 and carrying the vehicle with it. The result then is the vehicle dropping off of the trapdoor and along lower travel path 66.

FIGS. 8-13 illustrate an example of a further vehicle-related assembly 22. This vehicle-related assembly 22 may have one or a combination of actions, and accordingly may include one or more action devices 32. An action device may be adapted to produce selectively a given action and may include an actuator disposed along a vehicle path portion, the actuator being actuated by a vehicle traveling along a path portion for causing the action device to produce the given action. Shown in FIGS. 8-13 is a combination assembly 190 formed of a combination of action devices 32. Combination assembly 190 in this example includes trap assembly 30 as well as a disintegrator 192. Trap assembly 30 may be any structure or apparatus for receiving a vehicle falling into it. A disintegrator may be any device having a plurality of assembled elements and that is triggered by a vehicle traveling along a path or track to disassemble one or more of the elements.

Combination assembly 190 may include a base assembly 194 and a cover 196. Base assembly 194 in turn may include a base 198 and a mounting assembly 200 mounting the cover 196 onto the base 198. A trigger 202 included in the base may be disposed in line with the first path portion of the track, corresponding to track section 44. As shown in the figures, cover 196 defines a chamber 204 sized to receive and enclose a vehicle 68. The cover may be movable between open and closed positions and disposed below the trapdoor 142 for receiving a vehicle passing through the opening 144 when the trapdoor is in the open position. Cover 196 may be formed of one or a plurality of sections. In the example illustrated, cover 196 may include opposing cover sections 206 and 208, that when closed form a selected shape, such as an ancient tomb.

Cover sections 206 and 208 include, respectively, outer shells 210 and 212, and inwardly projecting actuating members 214 and 216 rigidly attached to the shells. When the cover sections are in the open position, shells 210 and 212 are spaced from each other, exposing chamber 204. Further, when the cover sections are in the open position, the actuating members extend slightly upwardly, and form in combination a platform 217 for receiving a falling vehicle.

Mounting assembly 200 also may include opposing mounting members 218 and 220. Mounting members 218 and 220 may be releasably attachable to respective opposite sides of base 198. Cover sections 206 and 208 may be hingedly attached along lower outside edges to corresponding upper outside edges of mounting members 218 and 220 at hinges 222 and 224. Protrusions on the sides of cover sections 206 and 208, such as protrusion 226, contact respective mounting members when the cover sections pivot to the open position, thereby limiting how far the cover sections pivot.

Figure 12:
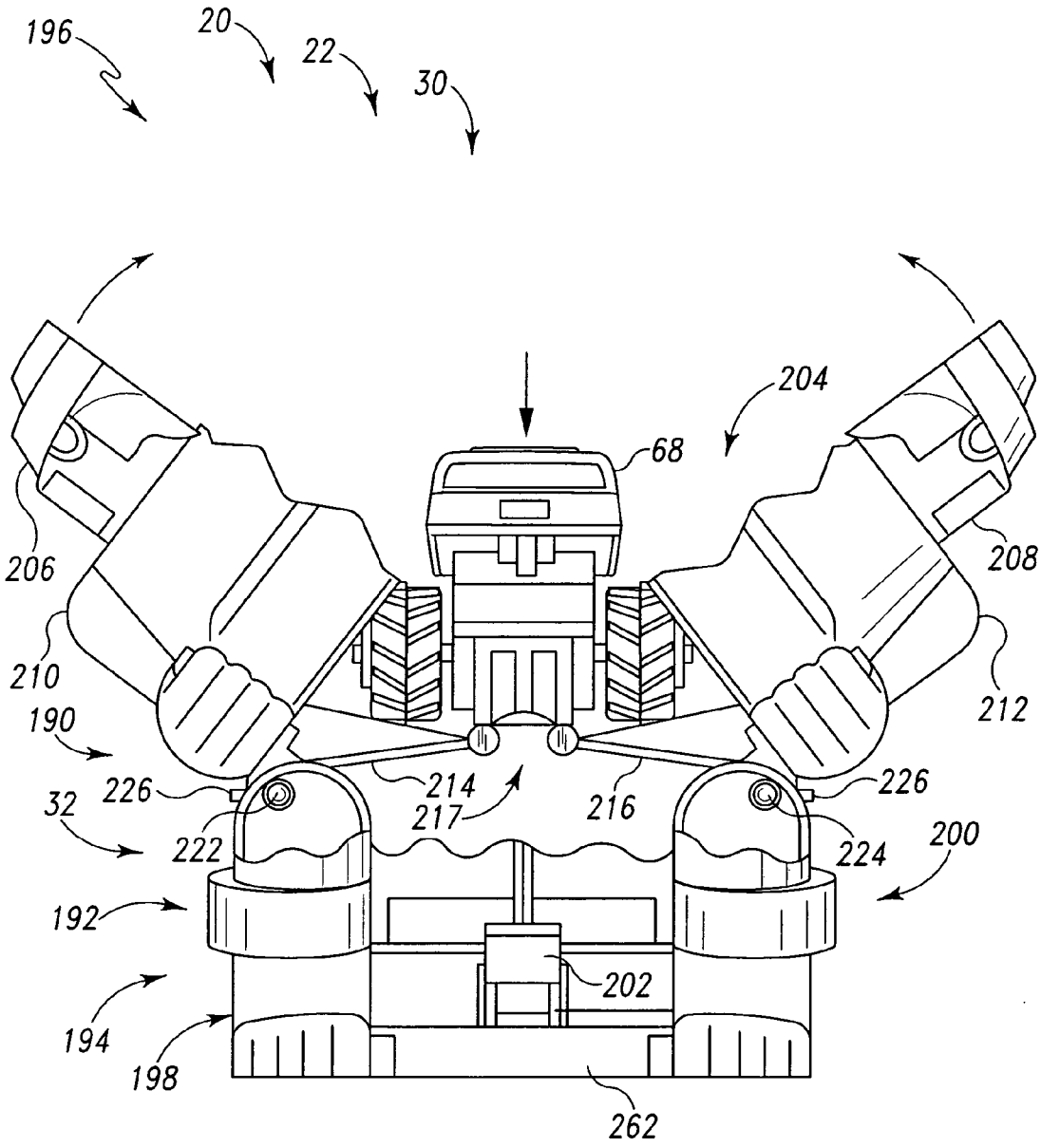
FIG. 12 is a simplified front view of the action assembly of FIG. 8.
Figure 13:
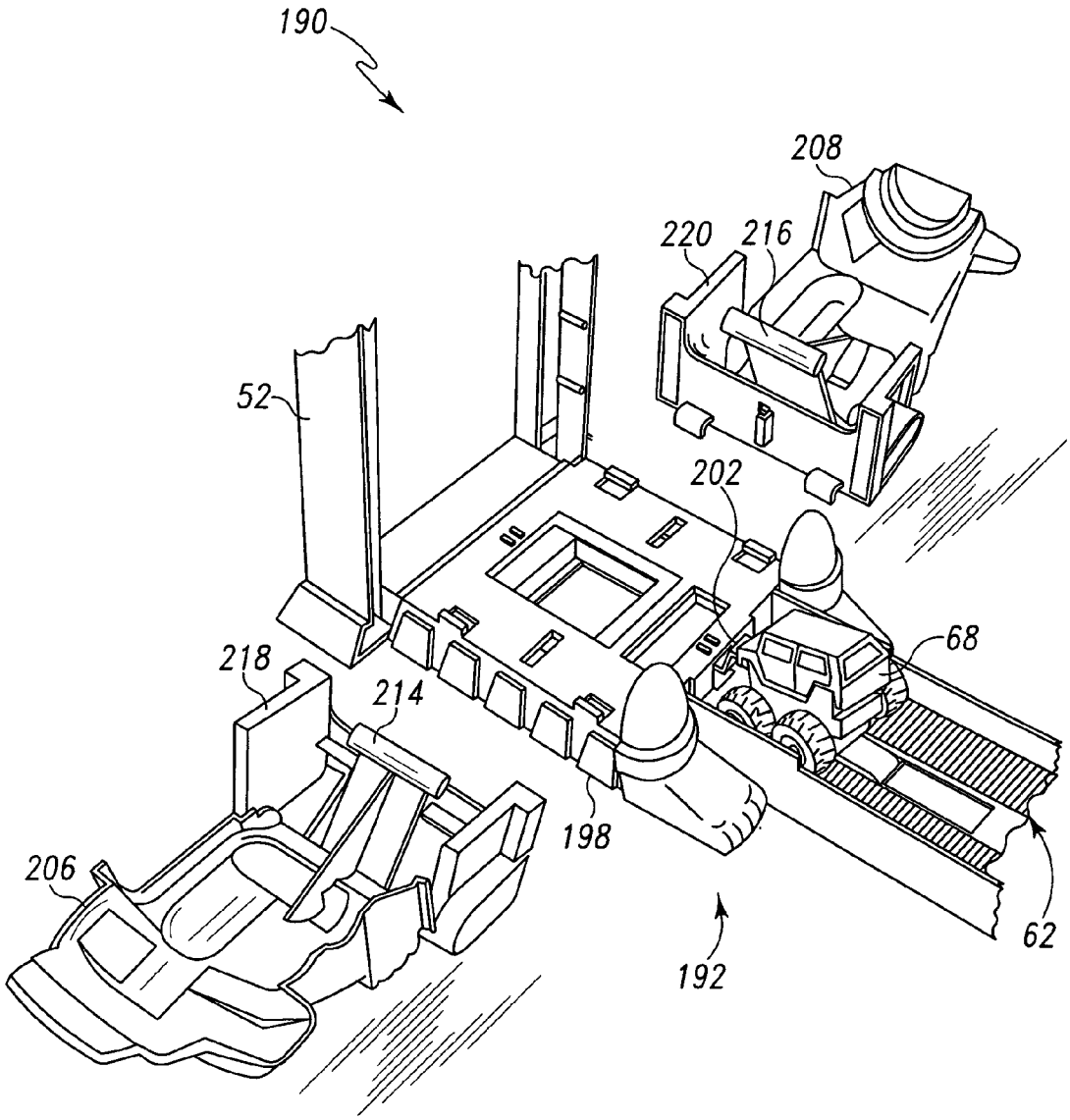
FIG. 13 is a simplified front view, similar to FIG. 9, of the action assembly of FIG. 8 and showing a vehicle in position after actuation of the action device.

In one example, cover 196 is formed of a resilient plastic material. It has been observed that in some instances, if an object strikes the top of the closed cover where the two cover sections come together, the cover sections flex downwardly and outwardly, causing them to pivot apart about the hinges 222 and 224, leaving the cover in the open position. The cover 196 may also be placed in the open position by manually separating cover sections 206 and 208. As the object continues to fall, the object may strike one or both of the actuating members 214, 216, as shown in FIG. 12. The downward force of the object on the actuating members may cause the cover sections to pivot about hinges 222 and 224 toward the closed position. When the cover sections return to the closed position, the object is retained in chamber 204, enclosed by cover 196.

The falling object may be a toy vehicle 68. The toy vehicle may fall through the opening 144 resulting from the collapse of the trapdoor 142. As has been explained, the toy vehicle may have been moving across the trapdoor too slowly, which in turn may have been caused by failing to switch the toy vehicle to a faster speed in the speed changer 100.

Figure 9:
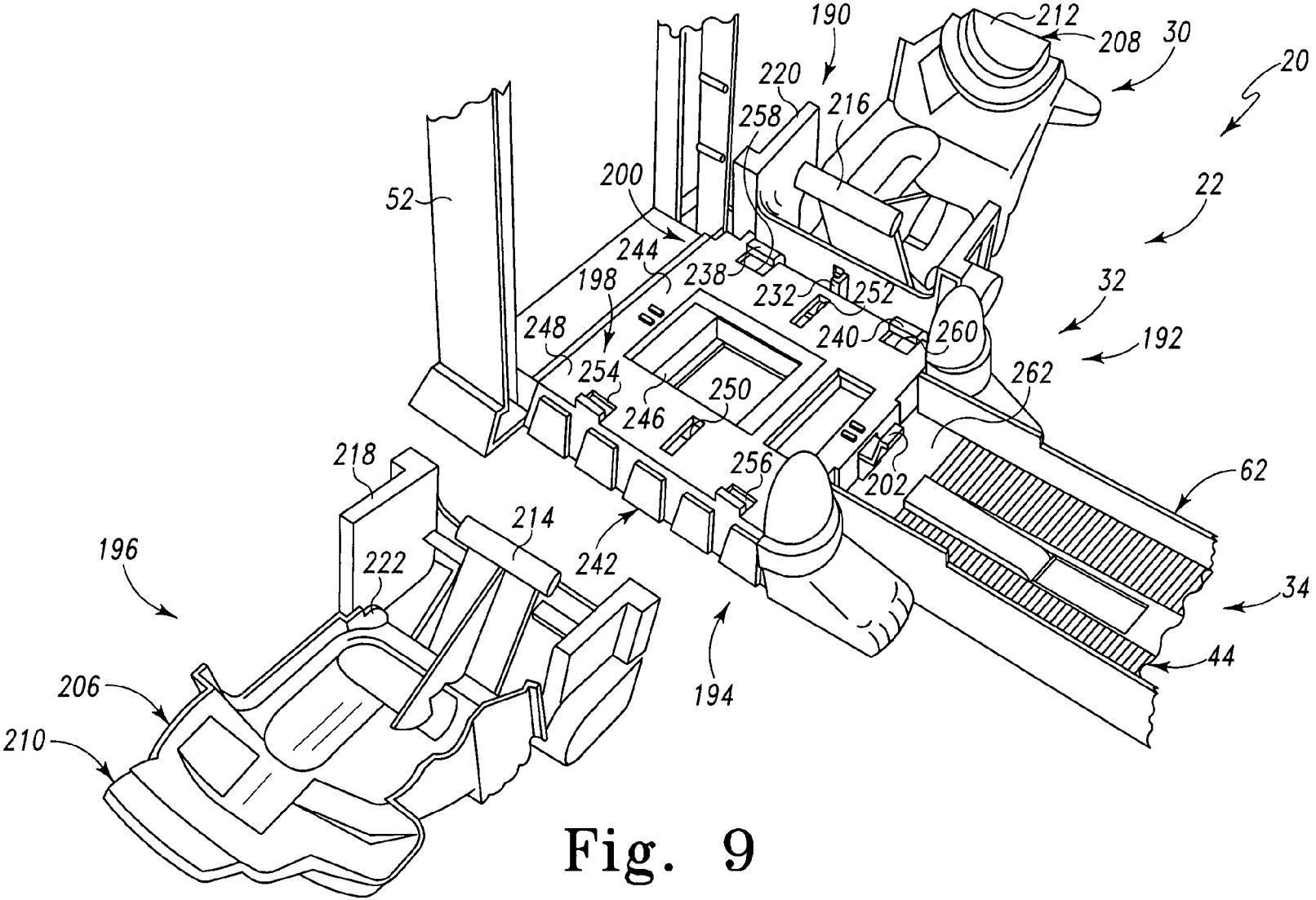
FIG. 9 is an isometric view of the action device of FIG. 8 in a condition after actuation by a toy vehicle.

FIG. 9 depicts the structure of the bottoms of the mounting members 218, 220 and the tomb base 198. The mounting members may each include at least one securing connector, such as connector 232 in mounting member 220. The securing connectors may be projections in the form of feet having a heel and a toe, or other suitable configuration that would allow the projection to be secured. The mounting members may further include at least one secondary tomb hinge connector, such as spaced-apart hinge connectors 238 and 240 on mounting member 220. The hinge connectors may provide a generally hooked shape, such as may be provided by a curved projection. An exemplary shape is a shape corresponding to a portion of a cylindrical surface.

Figure 8:
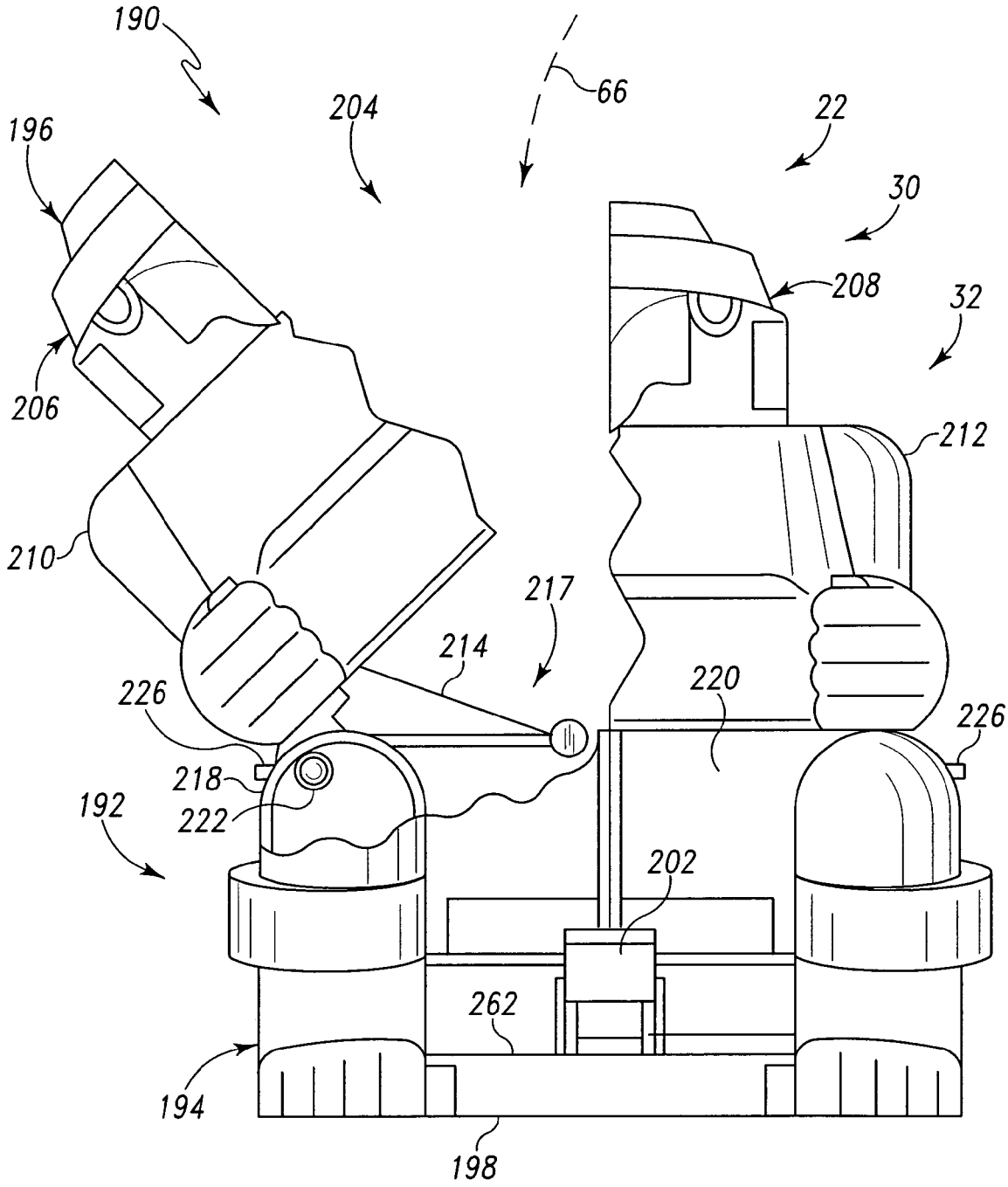
FIG. 8 is an end view of an action assembly included in the play set of FIG. 1.
Figure 10:
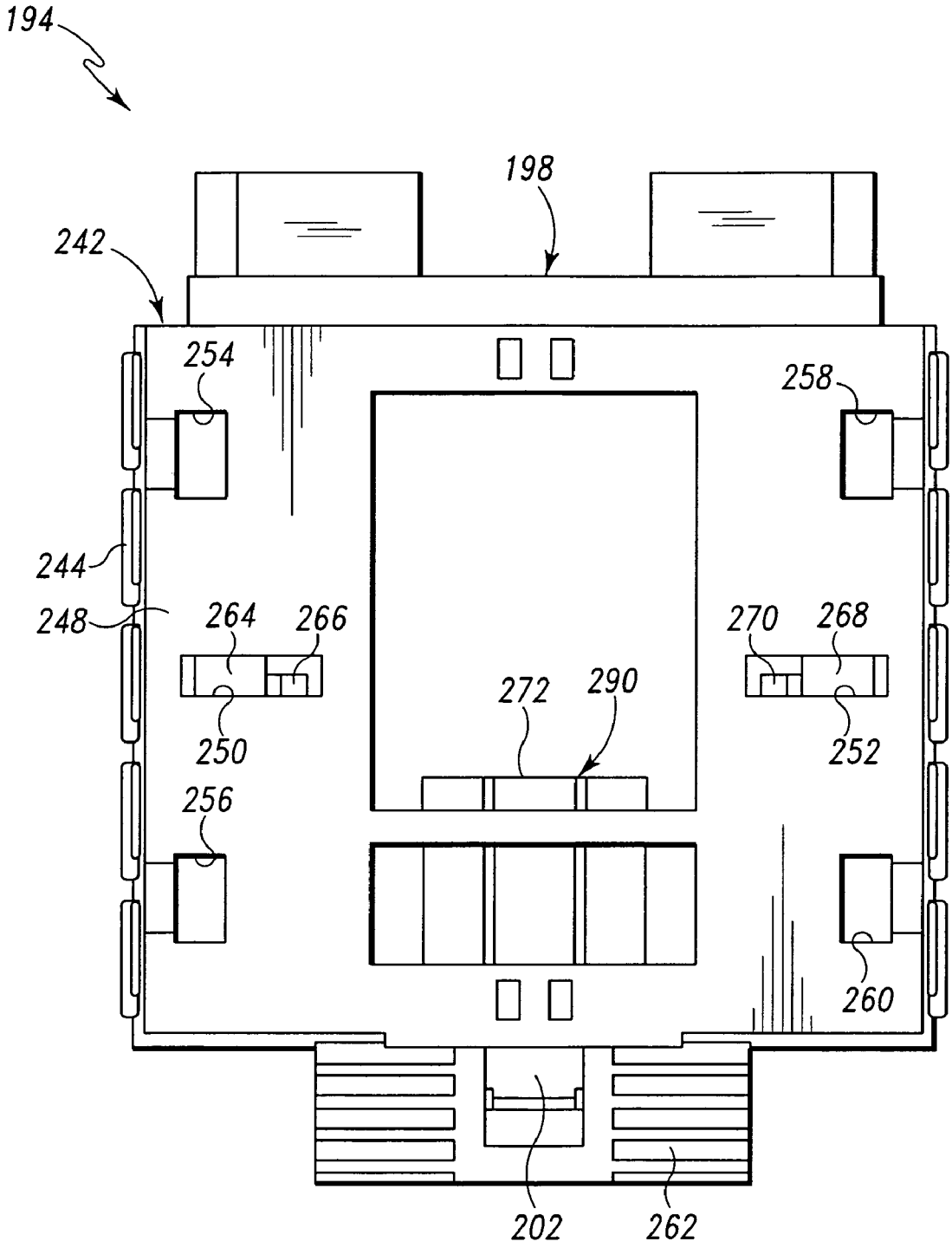
FIG. 10 is a top view of a base included in the action assembly of FIG. 8.
Figure 11:
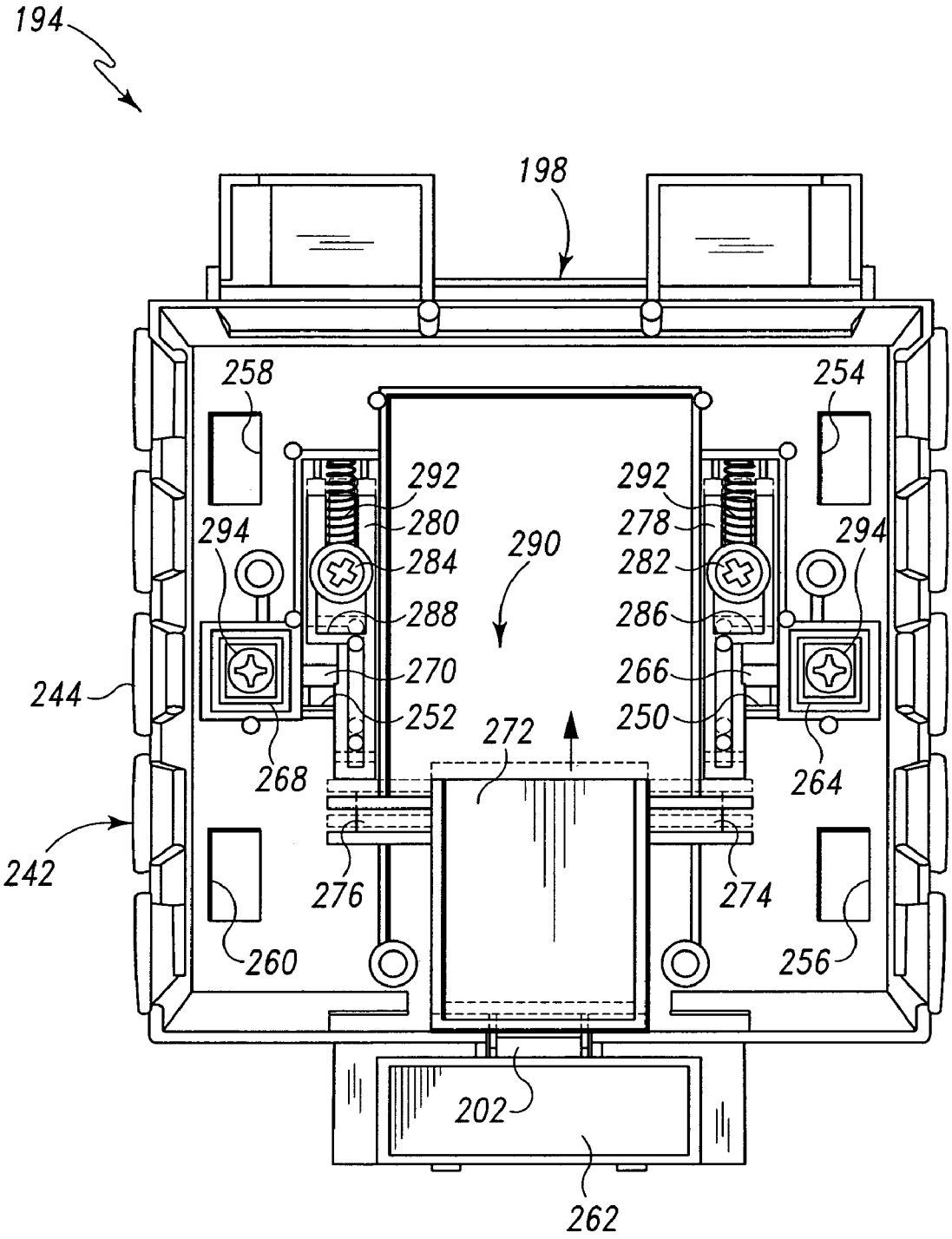
FIG. 11 is a bottom view of the base of FIG. 10 with a bottom cover removed.

As shown particularly in FIGS. 10 and 11, base 198 may include a housing 242 having an upper portion 244 and a lower portion 246. Upper portion 244 may have an upper surface 248 on which mounting members 218 and 220 are secured when in an assembled position, as shown in FIG. 8. Base upper surface 248 includes, for each mounting member 218, 220, a respective securing opening 250, 252 sized to receive a securing connector, such as connector 232. The base upper surface also includes, for each mounting member, a pair of spaced-apart hinge openings. Hinge openings 254 and 256 are associated with mounting member 218, and hinge openings 258 and 260 are associated with mounting member 220. The curved hinge connectors are shaped to wrap around corresponding edges of the hinge openings when the mounting members are mounted on the base.

In this example, base 198 further includes a porch 262 defining an end of track section 44. Trigger 202 projects out of housing 242 over porch 262. The tomb base 198 may further include a biased platform 264 and a tomb connector hook 266 disposed below secure opening 250, and a biased platform 268 and a tomb connector hook 270 disposed below secure opening 252. As particularly shown in FIG. 11, trigger 202 is connected to a connecting plate 272 having oppositely extending arms 274 and 276. Connector hooks 266 and 270 are portions of respective securing members 278 and 280 extending perpendicular to the ends of arms 274 and 276. Guide pins 282 and 284, attached to base upper portion 244, extend through elongate slots 286 and 288 in respective securing members 278 and 280. Trigger 202, connecting plate 272, and securing members 278 and 280 form a collective securing assembly 290 that is movable between a secure position and a release position. In the secure position, the trigger is extended from housing 242 and connector hooks 266 and 270 are disposed in line with secure openings 250 and 252. In the release position, the securing assembly is moved toward the rear of the base opposite the trigger, with the trigger partially recessed in the housing and the hooks retracted from openings 250 and 252. Respective biasing members, shown as springs 292 and 294, urge securing assembly 290 toward the secure position, shown by solid lines in FIG. 11. When the trigger is moved toward housing 242, the securing assembly is moved toward the release position, shown in dashed lines, compressing springs 292.

The bottom sides of biased platforms 264 and 168 are seen in FIG. 11. Each biasing member is urged toward base upper portion 244 by biasing members in the form of springs 294. The bottoms of these springs seat against base lower portion 246.

The mounting members 218 and 220 may be mounted onto base 198 by positioning the mounting members out sideways from the base with the leading edges of the tomb hinge connectors 254, 256, 258 and 260. The mounting members are then pivoted upwardly and inwardly, pivoting about the edges of the hinge openings. The securing connectors are thereby aligned with the respective secure openings 250 and 252. As the mounting members pivot into place, the securing connectors pass through the secure openings, depressing biased platforms 264 and 268 downwardly, and sliding connector hooks 266 and 270 laterally out of the opening and toward the release position. The hooks snap back into the secure openings over the feet of the securing connectors under the force of securing springs 292, securing the mounting members in place on the base 198. Alternatively or additionally, the mounting members may have one or more of the secure and hinge openings, and the base may correspondingly have one or more of the securing and hinge connectors.

Once the disintegrator 192 is assembled, it is ready for use in play set 20. A toy vehicle traveling along track section 44, may contact trigger 202, forcing it toward the release position. If the vehicle has enough momentum, the trigger is pressed far enough to move connector hooks 266 and 270 out of engagement with securing connectors, such as connector hook 270 corresponding to securing connector 232. The bias on biased platforms 264 and 268 drives the securing connectors upwardly through and out of secure openings 250 and 252. The secure openings are disposed inwardly from a line between the associated hinge openings. The upward force on the securing connectors then causes the mounting members to pivot upwardly and outwardly about hinge opening 254, 256, 258 and 260. The mounting members and connected cover sections 206 and 208 then tip outwardly from the base, and fall away from the base when the hinge connectors pivot out of the hinge openings. If the platform springs are sufficiently strong, the mounting members and cover sections can be propelled away from the base, simulating an explosion.

An exemplary method of game play utilizing the play set 20 will now be outlined. The user may begin by activating a multi-speed toy vehicle 68. The user may begin by activating the toy vehicle in the slower of the two speeds, sufficient for the vehicle to travel along the track 34 to one or a plurality of vehicle-related assemblies 22. Next, the toy vehicle may be positioned to climb up the ramp 50 of the track assembly 24 toward speed changer 100. Optionally, the toy vehicle may be positioned anywhere along the track. When the toy vehicle enters the speed changer 100, the speed of the toy vehicle may be changed when the user pushes down on the speed changer handle 120, resulting in the shifting of gears on the toy vehicle. If the previous speed of the toy vehicle was a slow speed, the speed of the toy vehicle may be shifted to a high speed.

The toy vehicle may then progress to the vehicle junction assembly along intermediate track section 42. If, however, the user did not change the speed of the toy vehicle or, for whatever reason, the toy vehicle is moving in a slower speed, then the trapdoor 142 may collapse, as has been described above. If the toy vehicle falls through the trapdoor opening 144, then the toy vehicle may drop onto trap assembly 30. If the trap cover 196 is open, the vehicle will drop into trap chamber 204, landing on actuating members 214, 216, causing the cover to close, pivoting about hinges 222 and 224.

If the tomb cover is closed and the toy vehicle lands appropriately on the tops of tomb cover sections 206 and 208, the cover sections may swing open about hinges 222 and 224, and the toy vehicle 10 may land inside the tomb chamber 204. When the toy vehicle 10 has landed inside the trap chamber, the trap cover may close due to the weight of the toy vehicle 10 on the actuating members, causing the vehicle to be completely enclosed inside of trap assembly 30.

If the user is successful in shifting the toy vehicle to the higher speed in the speed shifting section 42 of the track, then the toy vehicle may progress across the trapdoor assembly 138 and onto track section 44 without collapsing the trapdoor 142. Next, the vehicle may advance down track section 44 toward disintegrator 192. The toy vehicle may then contact trigger 202, shifting the securing assembly to the release position, causing the combination assembly 190 to disassemble, as if the vehicle caused the assembly to explode.

Several aspects of this exemplary method of game play may be modified from that disclosed above. Play may thus be configured to provide a game with a desired degree of complexity or difficulty, for example to adapt the game to players of a predetermined age range.

The play set 20 has various general features. The speed changer acts on a toy vehicle to change the operation of the toy vehicle. Further, the action of the toy vehicle on the subsequent trap assembly depends on the action taken at the speed changer. In turn, the action taken at the tomb trap combination assembly depends on the action taken at the speed changer, as well as the action taken at the trap assembly. Any one or more of these assemblies may be provided in a play set. However, the combination of assemblies provide an interactive and action-varying play set that involves the action and skills of the user.

Accordingly, it is believed that the disclosure set forth above encompasses multiple distinct inventions with independent utility. Selected inventions are defined by the appended claims. While an example of each of these inventions has been disclosed in a preferred form, the specific examples thereof as disclosed and illustrated herein are not to be considered in a limiting sense as numerous variations are possible. The subject matter of the disclosures includes all novel and non-obvious combinations and subcombinations of the various elements, features, functions and/or properties disclosed herein.

Similarly, where "a" or "a first" element or the equivalent thereof is recited, such usage should be understood to include incorporation of one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

Inventions embodied in various combinations and subcombinations of features, functions, elements, and/or properties may be claimed through presentation of claims in a related application. Such claims, whether they are directed to different inventions or directed to the same invention, whether different, broader, narrower or equal in scope to the other claims, are also regarded as included within the subject matter of the present disclosure.

INDUSTRIAL APPLICABILITY

The methods and apparatus described in the present disclosure are applicable to toys, games, and other devices, and other industries in which amusement devices are used.

What is claimed is:

1. A toy vehicle play set comprising:

a toy vehicle configured to perform a given operation, the toy vehicle including a body having first and second opposite sides, a plurality of wheels at least partially supporting the body including a first wheel on the first side of the body and a second wheel on the second side of the body and spaced from the first wheel, a drive mechanism drivingly coupled to one or more of the wheels for propelling the toy vehicle, and an operation-changing mechanism having an operation-changing element accessible from above the toy vehicle and vertically movable selectively to change a given operation of the toy vehicle;

a track assembly including a track having a first vehicle-support surface defining a travel path; and a vehicle-operation changing assembly mounted adjacent to the track and manually operable for selectively changing the given operation of the toy vehicle while the toy vehicle is supported in an operation-changing position, the vehicle-operation changing assembly including a fixed frame and a rigid movable frame, the movable frame being movable vertically relative to the fixed frame between a first position in which a contact surface of the movable frame is spaced from the operation-changing element and a vehicle-support surface aligned with the track supports directly the wheels of the toy vehicle that are drivingly coupled to the drive mechanism while the toy vehicle is in the operation-changing position, and a second position disposed below the first position in which the contact surface engages the operation-changing element, the vehicle-support surface is spaced below the wheels of the toy vehicle leaving unsupported the wheels of the toy vehicle drivingly coupled to the drive mechanism, and the body of the vehicle between the wheels is supported on and in contact with the fixed frame.

2. The play set of claim 1, in which the drive mechanism is configured to drive the vehicle selectively in at least first and second speeds, the operation-changing mechanism being a switch mechanism included in the drive mechanism and having a speed switch element movable for switching the speed of the vehicle; the operation-changing position is a speed-changing position, and the contact surface of the movable frame engages the switch element of the vehicle when the movable frame is moved from the first position toward the second position while the vehicle is supported in the speed-changing position.

3. The play set of claim 2, in which the switch element is configured to pivot relative to the vehicle body during switching of the vehicle speed, and the movable frame is operable for pivoting the switch element.

4. The play set of claim 2, in which all of the wheels of the toy vehicle are free of contact with any support surface when the movable frame is in the second position.

5. The play set of claim 2, in which the switch element forms a top surface of the vehicle and is movable vertically for switching the speed of the vehicle, and the fixed and movable frames straddle the track, forming a passageway containing the travel path, the fixed frame including a pedestal for supporting the toy vehicle body while the toy vehicle is in the speed-changing position and the movable frame is in the second position, and the speed changer member is biased toward the first position.

6. The play set of claim 3, in which the movable frame includes a handle extending above the fixed frame, the contact surface of the movable frame is disposed above the vehicle when the vehicle is in the speed-changing position, and the handle is movable downwardly for pressing the contact surface of the movable frame against the switch element.

7. The play set of claim 2, further comprising a vehicle junction assembly including a junction in the travel path providing a plurality of alternate path portions, and a path-switching mechanism having a track element moveable between a first travel-path portion and a second travel-path portion, and a release element moveable from a first position, in which the track element is retained along the first travel-path portion, to a second position in which the track element is allowed to move toward the second travel-path portion, the path-switching mechanism being actuatable by a vehicle traveling less that a first vehicle speed to move the release element from the first position toward the second position.

8. The play set of claim 7, in which the toy vehicle is configured to actuate the path-switching mechanism.

9. The play set of claim 8, in which the track assembly further includes a support assembly for supporting the track above a work surface, and the track element includes a trapdoor disposed in the track, the first position is a closed position in which the trapdoor is aligned with and forms a part of the track and fully supports a toy vehicle positioned on the trap door when the release element is in the first position, and the second position is an open position in which the trapdoor is removed from the closed position, and the path-switching mechanism is adapted to be actuated by the toy vehicle as the toy vehicle travels along the trapdoor.

10. The play set of claim 9, further comprising a vehicle trap assembly having a cover defining a chamber, the cover being movable between open and closed positions and disposed below the trapdoor for receiving a vehicle passing through the opening in the track when the trapdoor is in the open position.

* * * * *

UNITED STATES PATENT AND TRADEMARK OFFICE

CERTIFICATE OF CORRECTION

PATENT NO. : 7,628,673 B2
APPLICATION NO. : 11/333987
DATED : December 8, 2009
INVENTOR(S) : Bedford et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 687 days.

Signed and Sealed this

Second Day of November, 2010

David J. Kappos

David J. Kappos
*Director of the United States Patent and Trademark Office*